US005799600A

United States Patent [19]

Reuben

[11] Patent Number: 5,799,600

[45] Date of Patent: Sep. 1, 1998

[54] DOWN-FILL QUILTED FABRIC WITH COMBINATION STITCHED LINES AND TACK STITCHES

[76] Inventor: Ronnie Reuben, 8355 Labarre, Montreal, Quebec, Canada, H4P 2S5

[21] Appl. No.: 756,326

[22] Filed: Nov. 25, 1996

[51] Int. Cl.[6] ..... A47G 9/02; A41D 27/02

[52] U.S. Cl. ..... 112/420; 112/475.08; 112/475.09; 5/502; 2/97

[58] Field of Search ..... 112/475.08, 475.09, 112/420, 421, 422, 440, 117, 2.5, 2.1; 5/502; 428/102; 2/69, 97, 243.1, 93

[56] References Cited

U.S. PATENT DOCUMENTS

| | | | |
|---|---|---|---|
| 2,222,782 | 11/1940 | Moses | 112/420 X |
| 2,520,914 | 9/1950 | Crawford, Jr. | 112/420 X |
| 3,098,563 | 7/1963 | Skees . | |
| 3,405,674 | 10/1968 | Coates et al. | 112/420 |
| 3,837,021 | 9/1974 | Sellers et al. | 112/420 X |
| 4,384,541 | 5/1983 | Schneider | 112/421 |
| 4,962,554 | 10/1990 | Tesch | 112/420 X |
| 5,174,231 | 12/1992 | White | 112/420 |
| 5,408,700 | 4/1995 | Reuben et al. . | |
| 5,445,863 | 8/1995 | Slagle et al. | 112/420 X |

*Primary Examiner*—Peter Nerbun

*Attorney, Agent, or Firm*—Swabey Ogilvy Renault; Guy J. Houle

[57] ABSTRACT

A down-fill quilted fabric comprised of stitched lines and tack stitches as well as the method of fabrication of the fabric is described. A down-fill material is disposed between fabric sheets which are secured together by stitched lines. A plurality of tack stitches are disposed between the stitch lines to compress the down-fill material to reduce the thickness of the quilted fabric by at least twice the normal loft of the down-fill material while maintaining pliability of the fabric. The tack stitches eliminates stitch lines which produce cold spots and which add rigidity to the fabric. Such quilted fabric may be used as outer or inner fabric pieces in the manufacture of articles of apparel, for the fabrication of bedding quilts or other articles wherein an insulating fabric is desired.

9 Claims, 2 Drawing Sheets

DOWN-FILL QUILTED FABRIC WITH COMBINATION STITCHED LINES AND TACK STITCHES

TECHNICAL FIELD

The present invention relates to a down-fill quilted fabric having spaced-apart stitch lines and a plurality of tack stitches whereby to compress the down-fill material to reduce the thickness thereof while maintaining pliability of the fabric.

BACKGROUND ART

In my U.S. Pat. No. 5,408,700 issued on Apr. 25th, 1995, I describe a down-fill fabric and wherein the thickness of the down-fill material is reduced from its normal loft by cross-stitched patterns which delineate small areas over the entire surface of the fabric. As described in that Patent such material may be used as an inner lining material or the outer layer of an article of apparel. Such material has found many utilities in the fabrication of articles of apparel. However, because of the closely stitched pattern, the insulation value of the material is reduced as the stitched lines produce cold spots because the material is highly compressed and does not provide insulation along the stitched lines. Also, the closely spaced stitch line adds rigidity and stiffness to the material and this eliminates certain applications thereof where material softness and pliability is desirable. Another inconvenience is in the fabrication of this thermally insulated fabric in that the many stitch lines required to produce the composite cross-stitch pattern while compressing the down-fill material is labour intensive. There was therefore the need to produce a down-fill quilted fabric wherein the down could be compressed, the stitch lines reduced to a minimum to reduce cold spots and wherein the fabric would retain its softness and pliability.

SUMMARY OF INVENTION

It is therefore a feature of the present invention to provide a quilted fabric which substantially meets the above need and reduces the above-mentioned inconveniences.

Another feature of the present invention is to provide a quilted fabric which is comprised of a down-fill material sandwiched between opposed fabric sheets and retained therein, in compression by spaced-apart stitch lines and a plurality of tack stitches.

Another feature of the present invention is to provide a method of producing the quilted fabric as afore-mentioned including stitch lines and tack stitches.

According to the above features, from a broad aspect, the present invention provides a quilted fabric comprising a pair of opposed fabric sheets secured together by spaced-apart stitch lines. A down-fill material is disposed between the fabric sheets. A plurality of tack stitches are disposed between the stitch lines to compress the down-fill material to reduce the thickness of the quilted fabric while maintaining pliability of the fabric.

According to a further broad aspect of the present invention there is provided a method of producing quilted fabric and which comprises positioning down-fill material between opposed fabric sheets. Spaced-apart stitch lines are then stitched between the fabric sheets to secure the down-fill material between the fabric sheets. A plurality of tack stitches are then formed between the stitch lines to compress the down-fill material to reduce the thickness of the quilted fabric while maintaining pliability of the fabric.

According to a further broad aspect of the present invention there is provided a quilted fabric and a method of making same and wherein the down-fill material is compressed to at least twice the normal loft thereof without substantially reducing the thermal insulation value of the fabric.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
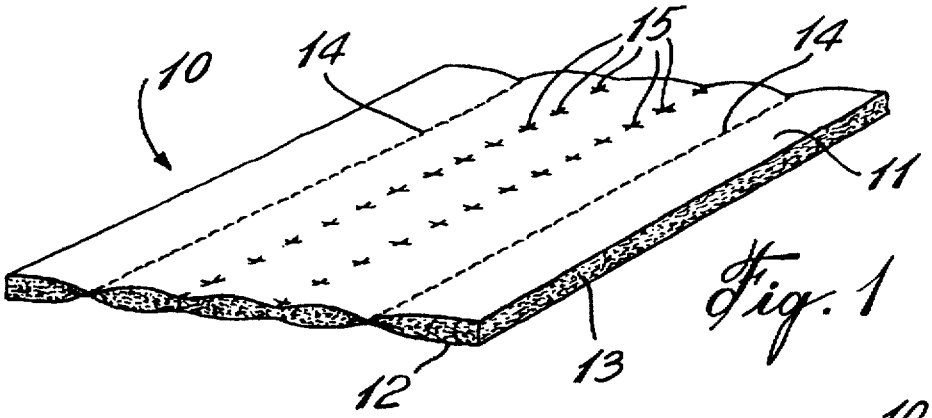
FIG. 1 is a perspective view illustrating the construction of the quilted fabric of the present invention.

Referring now to the drawings, and more particularly to FIG. 1, there is shown generally at 10 the quilted fabric of the present invention and which is formed by opposed fabric sheets, herein a top material sheet 11 and a bottom material sheet 12 and having a down-fill material or other fluffy material 13 sandwiched therebetween. The quilted fabric is formed by stitching spaced-apart stitch lines 14 at spaced intervals or in any pattern form to interconnect the outer and inner fabric sheets 11 and 12 and to maintain the down-fill material 13 substantially immovably between these fabric sheets. The stitch lines 14 may extend parallel to each other and may criss-cross to form patterns, but preferably these stitch lines should be spaced-apart as far as possible, usually a distance of about 6 inches, whereby to reduce the formation of "cold spots" along the stitch lines.

Figure 2:
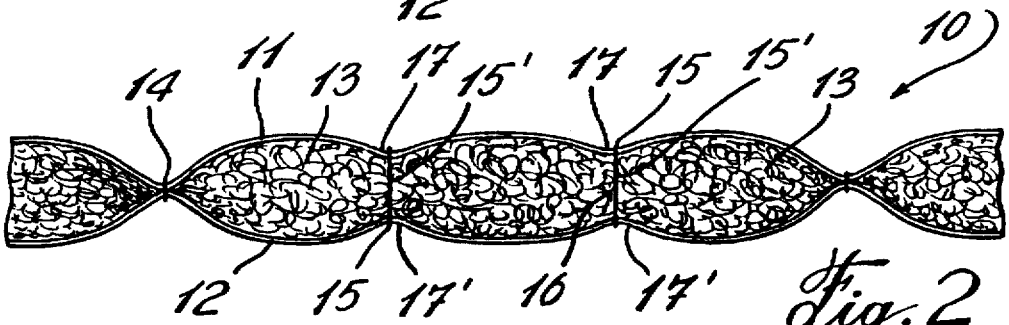
FIG. 2 is a sectional view through a portion of the quilted fabric material of FIG. 1.

FIG. 2 shows the stitch lines 14 which connect the outer and inner fabric pieces to one another. As can be seen the thermal insulating down-fill material 13 within the area of the stitch lines 14 is compressed and therefore the thermal insulating value in the area of the stitches is substantially reduced thus forming the so called "cold spot". However, it is desirable to maintain the down-fill material in position and substantially evenly distributed throughout the fabric. To accomplish this, I have found that by producing tack stitches 15 having an inner thread length 15' and in a predetermined pattern or any other suitable patterns along the areas between the stitch lines 14 or any other patterned stitched lines that I can maintain the down-fill material in position and compress down it to at least half the normal left thickness of the down-fill material when in its natural, uncompressed state. This substantially reduces the formation of cold spot while producing a quilted fabric which is thinner than standard quilted fabric without the tack stitches due to the fact that the thickness of the normal loft of the down-fill is reduced. Furthermore, these tack stitches retain the pliability and softness of the fabric by eliminating as much as possible the stitch lines 14 which form rigid lines.

As can be seen from FIG. 2 the tack stitches 15 are comprised of the threads 15' having a predetermined length to interconnect the opposed fabric sheets 11 and 12 but spaced from one another whereby to form an internal gap 16 between the opposed stitch areas 17 and 17' and throughout which down-fill material 13 is compressed somewhat but still provides thermal insulation in the gap 17.

Figure 6:
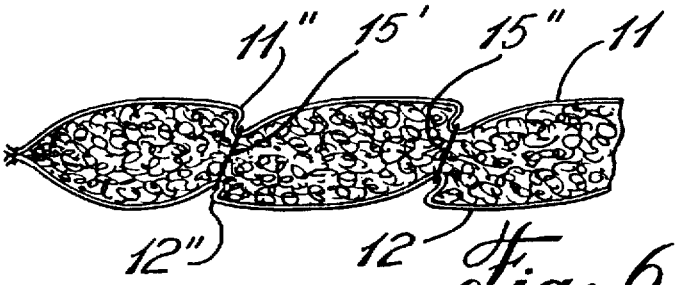
FIG. 6 is a section view illustrating the tack stitches formed in the quilted fabric but being disposed at a slanted angle.

In FIG. 6 the loosetack stitch 15' is provided at an angle of inclination to produce slanted thread stitches which I have found allows interstitial portions 11" and 12" of the fabric to slant against each other in the areas 11' and 12' to produce a very soft and appliable fabric sheet. It is also possible to make a tight tack stitch as shown at 15" wherein opposed fabric sheets 11 and 12 touch each other or are brought together.

Figure 3:
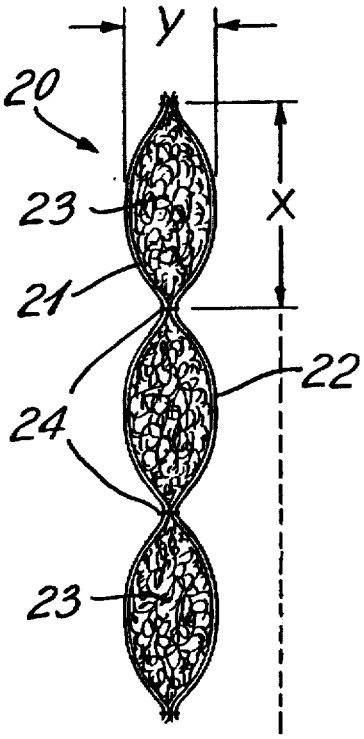
Fig. 3 (PRIOR ART)
FIG. 3 is a section view of a portion of a standard quilted fabric known in prior art.
Figure 4:
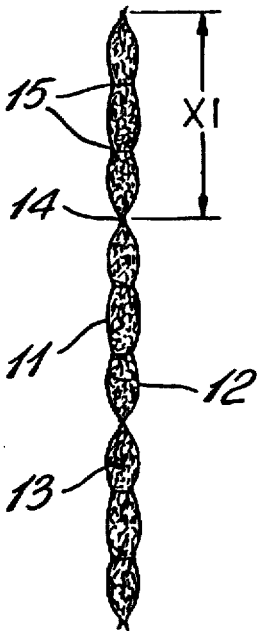
FIG. 4 is a section view illustrating the quilted fabric of the present invention to illustrate a comparison with the prior art quilted fabric.

FIG. 3 illustrates a normal quilted fabric 20 of the prior art. As hereinshown the fabric 20 is comprised of opposed fabric sheets 21 and 22 having a down-fill material 23 sandwiched therebetween and retained in position by stitch lines 24. A plurality of the stitch lines are provided and may be patterned as desired. With normal quilt stitching the stitch lines 24 are usually spaced apart between 3 to 7 inches and the loft rise is usually between 2 to 5 inches depending on the quilt pattern size and the quality of the down-fill material 23. As shown in FIG. 4 by providing my tack stitches 15 between the stitch lines 24 and with a loose thread 15' having a length in the range of between 1/16 to ½ an inch and which allow the down-fill material to extend through the gap 16 to avoid cold spots, I reduce the overhall thickness of the down-fill material within the range of less than 1 to 2½ inches. My tack stitches are spaced apart a distance of between about ¾ to 2 inches depending on the use of the fabric and the quality of the down-fill material.

Figure 5:
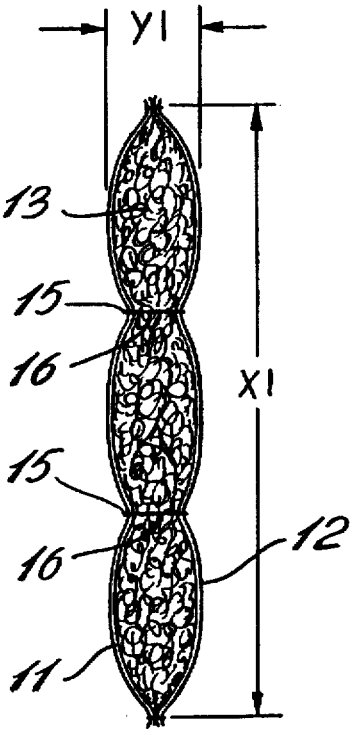
FIG. 5 is an enlarged section view of a portion of FIG. 4.

In FIG. 3 the letter "y" illustrates the thickness of a prior art quilted fabric. The distance "X" is that distance between adjacent stitch lines 24, and as can be seen in FIG. 4 this distance as now appearing as X1, includes a plurality of tack stitches 15 therebetween. This distance X1 is enlarged in FIG. 5 to better illustrate that the thickness Y1 of the loft has been reduce to at least twice that of the thickness Y illustrated in FIG. 3 and with the down-fill material 13 extending through the gap 16 created by the tack stitches 15.

Figure 7:
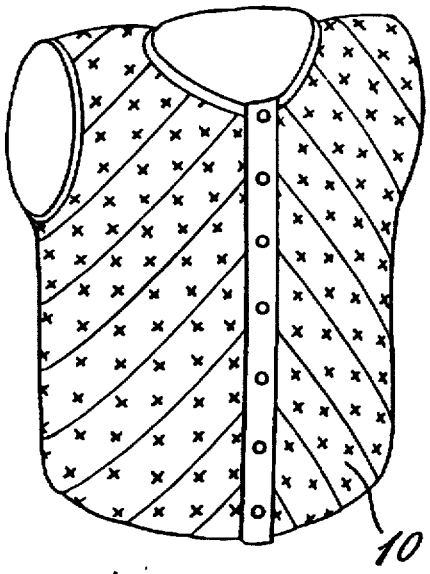
FIG. 7 illustrates the quilted fabric of the present invention as used in the fabrication of an outer fabric of an article of apparel.
Figure 8:
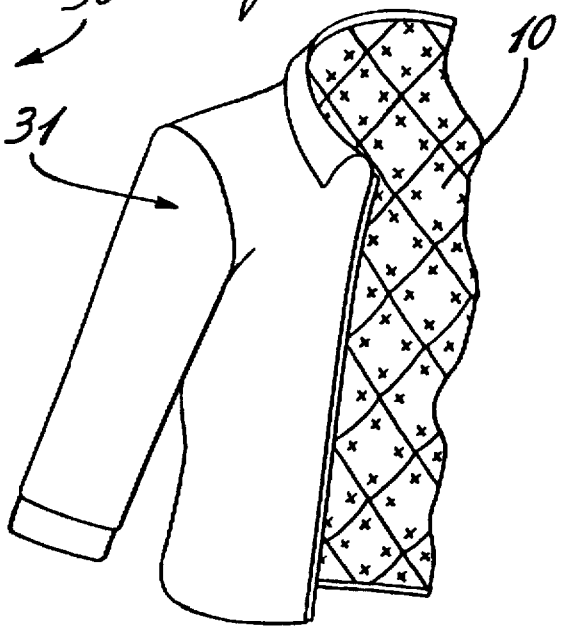
FIG. 8 illustrates a quilted fabric as utilized as an inner fabric piece of an article of a apparel.
Figure 9:
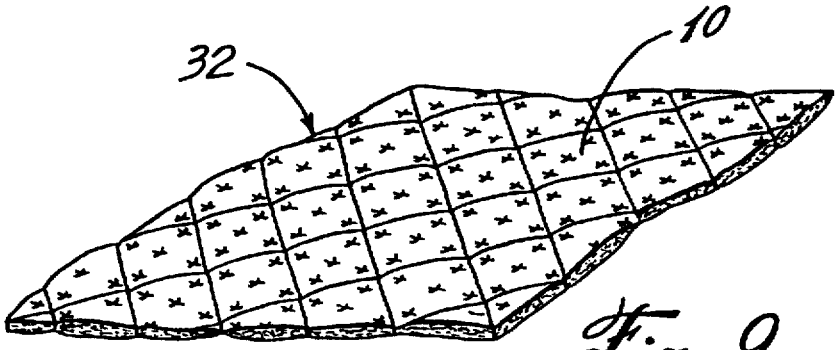
FIG. 9 is a prespective view showing a bedding quilt formed with the quilted fabric of the present invention.

The method of fabrication comprises positioning the down-fill material 13 between opposed fabric sheets 11 and 12 which my be die-cut to a pattern whereby to produce an article of clothing as shown in FIGS. 7 and 8. Stitched-apart stitch lines 14 are then formed to secure the down-fill-material between the fabric sheets. A plurality of tack stitches 15 are also formed between the stitch lines 14 to compress the down-fill material to reduce the thickness of the quilted fabric while maintaining pliability thereof. The fabric material thus formed has a reduced thickness, excellent thermal insulating values, provides an aesthetically pleasing design and may be used to produce an article of apparel 30, as shown in FIG. 7, wherein the quilted fabric 10 is used as the outer fabric of the article of apparel. In FIG. 8 the quilted fabric 10 of the present invention is hereinshown used as an inner liner for the article of apparel 31. FIG. 9 shows a bedding quilt 32 formed with the quilted fabric 10 of the present invention.

It is within the ambit of the present invention to cover any obvious modifications of the examples of the preferred embodiment described herein, provided such modifications fall within the scope of the appended claims. For example it is also intended to form patterned pouches having a down-fill material therein and the pauch closed by contour stitching. The down-fill is then secured in place and compressed by tack stitches distributed throughout the surface area of the patterned pauch. The tack stitches may be loose tack stitches 15' or light tack stitches 15".

I claim:

1. A quilted fabric comprising a pair of opposed fabric sheets secured together by spaced-apart stictch lines disposed in a pattern form, a down-fill material having a normal loft disposed between said fabric sheets in a layer, said stitched lines maintaining said down-fill material substantially immovable between said fabric sheets and a plurality of tack stitches disposed between said stitch lines to compress said down-fill material to reduce said thickness of said fabric and therefore the thickness of said down-fill fabric while maintaining pliability of said fabric, said tack stitches each being comprised of a thread portion interconnecting opposed stitch areas of said pair of fabric sheets close to one another while maintaining said fabric sheets spaced-apart throughout the entire region between said spaced apart stitch lines, said thread portion forming an internal gap defined between the opposed stitch areas at each of said tack stitches and in which said down-fill is compressed to reduce said loft of said down-fill material and the thickness of said quilted fabric to at least half said normal loft of said down-fill material.

2. A quilted fabric as claimed in claim 1 wherein said tack stitches are disposed at substantially equidistantly spaced intervals between said spaced-apart stitched lines.

3. A quilted fabric as claimed in claim 1 wherein said tack stitches are comprised of slanted thread portions to cause interstitial portions of said fabric sheets between said tack stitches to slant against each other.

4. A quilted fabric as claimed in claim 2 wherein said tack stitches are spaced-apart a distance of between about ¾ inches to 2 inches.

5. A quilted fabric as claimed in claim 1 wherein said stitch lines are spaced-apart within the range of about 3 inches to 7 inches with said loft of said down-fill material varying within the range of about 2 inches to 5 inches, said internal gap of said tack stitch being within the range of from about 1/16 inch to ½ inch.

6. A quilted fabric as claimed in claim 1 wherein said internal gap of said tack stitch is within the range of from about 1/16 inch to ½ inch.

7. A quilted fabric as claimed in claim 1 wherein said fabric is an outer fabric piece of an article of apparel.

8. A quilted fabric as claimed in claim 1 wherein said fabric is an inner fabric piece of an article of apparel.

9. A quilted fabric as claimed in claim 1 wherein said fabric is a bedding quilt.

* * * * *